US006513583B1

(12) United States Patent
Hughes

(10) Patent No.: US 6,513,583 B1
(45) Date of Patent: Feb. 4, 2003

(54) HEAT EXCHANGER

(75) Inventor: Steve John Hughes, Birmingham (GB)

(73) Assignee: Serck Aviation Limited, Birmingham (GB)

( * ) Notice: Subject to any disclaimer, the term of this patent is extended or adjusted under 35 U.S.C. 154(b) by 0 days.

(21) Appl. No.: 09/786,812

(22) PCT Filed: Sep. 24, 1999

(86) PCT No.: PCT/GB99/02971

§ 371 (c)(1),
(2), (4) Date: Apr. 23, 2001

(87) PCT Pub. No.: WO00/17593

PCT Pub. Date: Mar. 30, 2000

(30) Foreign Application Priority Data

Sep. 24, 1998 (GB) ..... 9820712

(51) Int. Cl.[7] ..... F28F 9/22; F28F 9/00
(52) U.S. Cl. ..... 165/159; 165/162
(58) Field of Search ..... 165/159, 162, 165/166

(56) References Cited

U.S. PATENT DOCUMENTS 3,400,758 A 9/1968 Lee
4,249,593 A * 2/1981 Bieberbach et al. ..... 165/70
4,697,321 A 10/1987 Hisao et al.
5,327,957 A * 7/1994 Killebrew ..... 165/159
5,915,472 A * 6/1999 Takikawa et al. ..... 165/158
5,941,302 A * 8/1999 Hattori et al. ..... 165/159

FOREIGN PATENT DOCUMENTS

| | | |
|---|---|---|
| DE | 29612361 | 8/1996 |
| EP | 311158 | 4/1989 |
| GB | 226296 | 12/1924 |
| GB | 308715 | 5/1930 |
| GB | 667281 | 2/1952 |
| GB | 2005820 | 4/1979 |
| GB | 142715 | 4/1989 |
| WO | WO 97/24573 | 7/1997 |

* cited by examiner

*Primary Examiner*—Henry Bennett
*Assistant Examiner*—Tho V Duong
(74) *Attorney, Agent, or Firm*—Caesar, Rivise, Bernstein, Cohen & Pokotilow, Ltd.

(57) ABSTRACT

A heat exchanger has a shell formed of several sections placed side by side and each defining an intermediate baffle forming part of a spiral surface. The adjacent sections define together a spiral path extending through the shell in the direction of its axis. Tubes extend in this axial direction through aligned holes provided in each shell section. The tubes communicate between end spaces comprising an inlet and outlet for the first fluid. The use of shell sections provides a convenient construction method for the heat exchanger while the spiral path for the second fluid gives better flow characteristics.

10 Claims, 4 Drawing Sheets

HEAT EXCHANGER

This invention relates to a heat exchanger, more particularly but not exclusively to a shell and tube heat exchanger.

A known shell and tube heat exchanger comprises a cylindrical container with parallel tubes extending between two end baffles in the container so that a first fluid can pass through the tubes from one side of one end baffle to past the other baffle. Meanwhile, a second fluid flows in and through the space between the two end baffles so as to come into contact with the tubes. To give best heat exchange between the two fluids, the flow of the second is controlled by intermediate baffles which define respective non-aligned passages so the second fluid has to change direction in passing from one passage to the next. The intermediate baffles could comprise annular rings and discs so the second fluid has to change direction radially from one to the next of they could comprise disc segments so the flow of the second fluid is segmental.

With both forms of flow, i.e. radial and segmental, the second fluid has to change direction several times along the length of the shell. This causes a reduction in the dynamic pressure of the second fluid, which can, in turn, adversely effect the performance of the heat exchanger.

It is an object of the present invention to reduce the effects of the above disadvantages and generally provide a heat exchanger of improved construction and with improved heat exchange characteristics.

In accordance with a first aspect of the invention, a shell and tube type heat exchanger comprises a tubular shell containing a spiral baffle path defined by a spiral baffle through which a tube bundle extends in a direction generally parallel with the longitudinal direction of the tubular shell, the heat exchanger comprising an assembly of a plurality of heat exchange elements each of which comprises a shell section to form part of the axial length of the shell and a spiral section to form part of the length of the spiral baffle path.

The shell and baffle sections of the or at least some of the heat exchange elements may be integrally formed, e.g. by casting or moulding.

A spiral baffle section may be secured to, or integrally formed with, e.g. by casting or moulding, a central member, for example, in the form of a rod or tube and each element may include said central member.

A plurality of heat exchange elements assembled in series to form a heat exchanger may be united by, for example, welding or by bonding with adhesive.

The spiral section may be in the form of a single curved sheet which executes one or more complete turns around the inner surface of the shell section. The spiral baffle section may be in the form of several curved sheets, each one of which executes one turn or the same whole number of turns around the inner surface of the length of the shell.

The heat exchanger may comprise a plurality of identified heat exchange elements. The shell sections may be, for example, of circular or square shape as seen in plan view.

In accordance with a second aspect of the invention a shell and tube heat exchanger comprises a cylindrical shell, two tube plates, and a tube bundle supported by the tube plates, a region of the shell located between the tube plates and extending around the whole periphery thereof being inwardly or outwardly deformed and allowing differential expansion between the shell and the tube bundle.

Said cylindrical shell may be defined by the outer regions of a plurality of heat exchange elements as described herein and arranged in series.

In accordance with a yet further aspect of the invention there is provided a heat exchange element for a modular type heat exchanger, said element comprising a shell section to form part of the axial length of a shell and a spiral section to form part of a spiral baffle path.

For a better understanding of the intention and to show how the same may be carried into effect, reference will now be made, by way of example, to the accompanying drawings in which.

Figure 1:
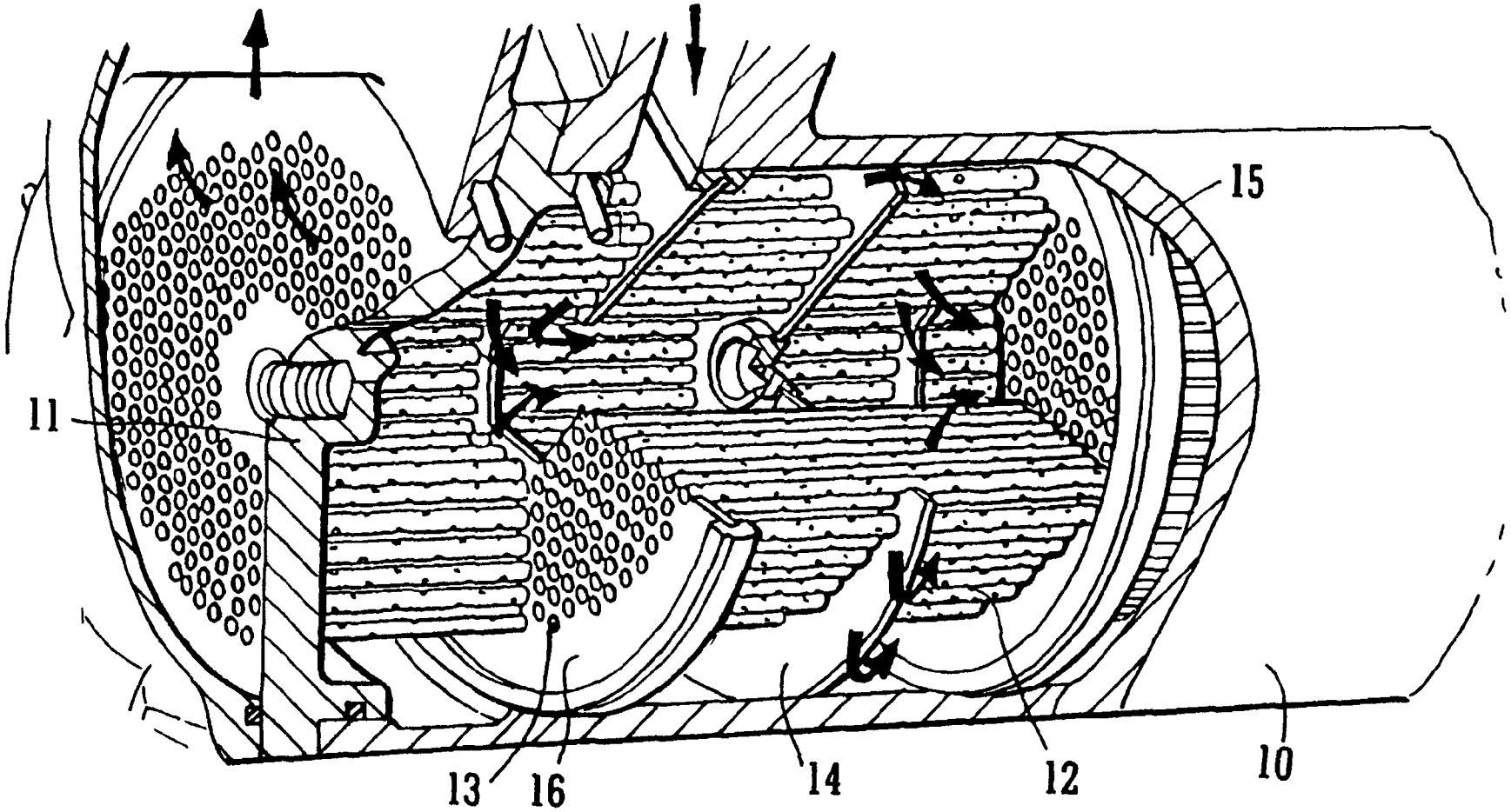
FIG. 1 is a partial perspective view of part of a first known type of shell and tube heat exchanger.
Figure 2:
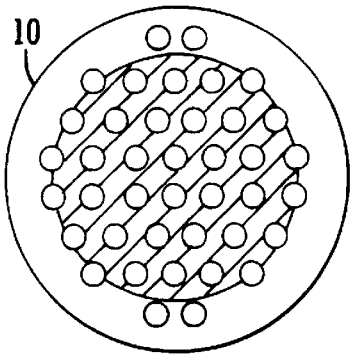
FIG. 2 is a radial cross-section corresponding to FIG. 1, the section being taken on line A—A of FIG. 3.
Figure 3:
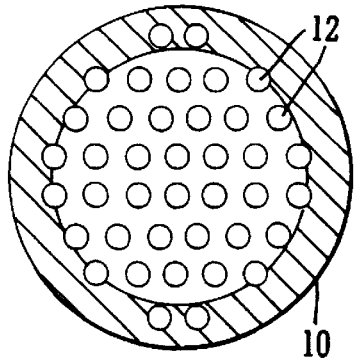
FIG. 3 is a partial longitudinal cross-section corresponding to FIG. 1.
Figure 4:
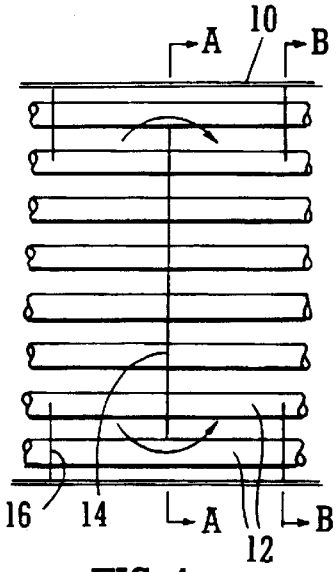
FIG. 4 is a radial cross-section on line B—B of FIG. 3.

The heat exchanger of FIGS. 1 to 4 comprises a cylindrical shell 10, two end tube plates 11 (only one shown in FIG. 1) and a plurality of tubes 12 extending parallel to one another and to the axis of the shell 10 between the two end tube plates. One fluid such as fuel is passed along the interiors of the tubes 12 and exchanges heat energy with a second fluid such as oil, flowing externally around the tubes 12 and within the shell 10.

Baffles 14 and 16, through which the tubes pass, are provided within the shell 10 to direct the flow of the second fluid. The baffles are in two shapes, i.e. flat discs 14 and flat rings 16 arranged alternately along the length of the shell. The planes of the baffles extend perpendicularly to the longitudinal axis of the shell. The discs 14 each have an external diameter less than the internal diameter of the cylindrical shell 10. The rings 16 each have an external diameter only slightly less than that of the internal diameter of the shell 10 and an internal diameter greater than that of the external diameter of the disc 14. Each of the rings 16 has a baffle seal 15 around its periphery which makes sealing contact with the interior of the shell. As can be seen from the arrows in FIGS. 1 and 3, the second fluid inside the shell 10 is caused to flow not only axially in the direction of the length of the shell 10 but also radially, i.e. alternately towards and away from the shell axis. This flow is termed "radial flow".

Figure 5:
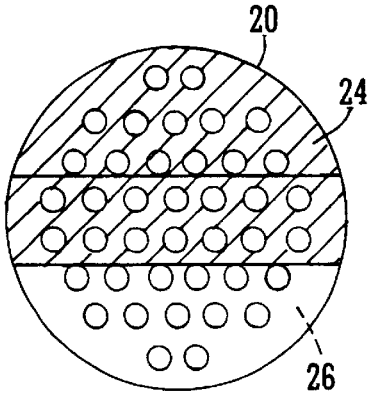
FIG. 5 is a radial cross-section of a second known type of shell and tube heat exchanger, the section being taken on line C—C of FIG. 6.
Figure 6:
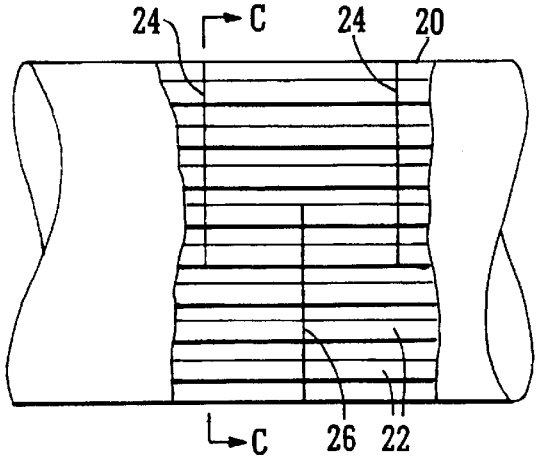
FIG. 6 is a partial longitudinal cross-section corresponding to FIG. 5.

The heat exchanger of FIGS. 5 and 6 comprises a cylindrical shell 10, two end tube plates (not shown) and a plurality of tubes 22 extending parallel to one another and to the axis of the shell 20 between the two end tube plates. One fluid is passed along the interiors of the tubes 22 and exchanges heat energy with a second fluid flowing externally around tubes 22 and within the shell 20. Baffles are provided to direct the flow of the second fluid and are each in the form of flat discs, 24, 26 from which a segment has been removed. The plane of each baffle extends perpendicularly to the longitudinal axis of the shell. Each baffle is the same and covers an area of approximately three quarters of the radial cross-section of the interior of the shell, but the baffles are arranged to extend alternately from the top and bottom of the shell, as can be seen in FIGS. 5 and 6. Thus, the second fluid flowing within the shell flows not only axially in the direction of the length of the shell 20 but also up and down, as can be seen by the arrows in FIG. 6. This flow is termed "segmental flow".

Figure 7:
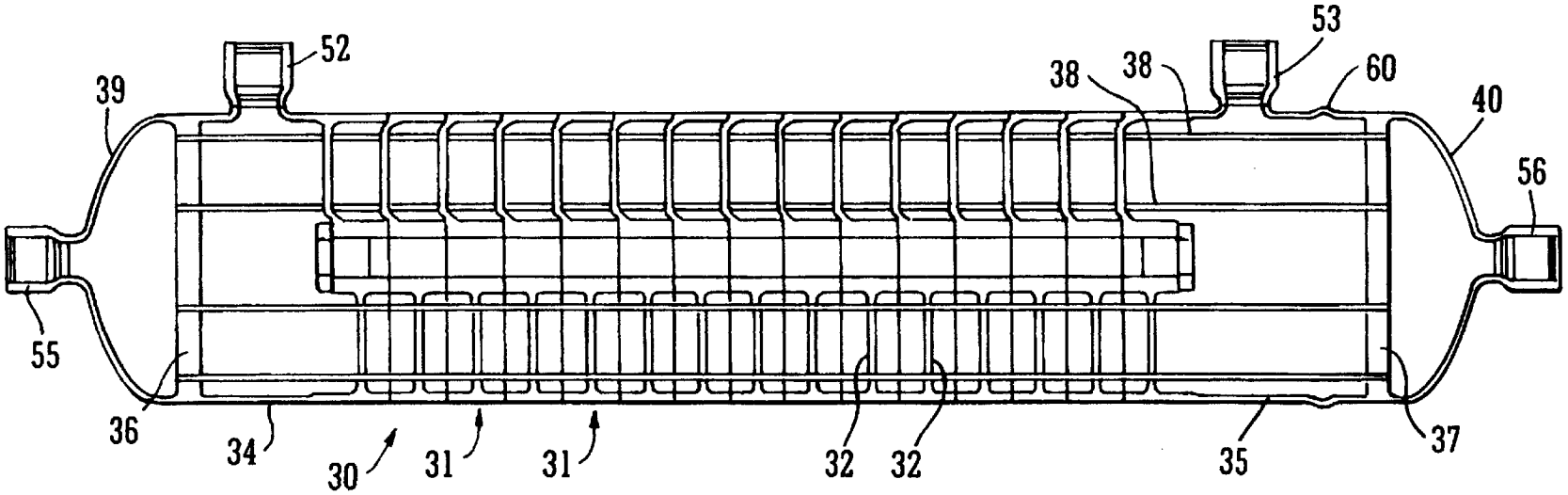
FIG. 7 is a longitudinal cross-section through a shell and tube heat exchanger in accordance with the invention.

As can be seen in FIG. 7 the shell and tube type heat exchanger 30 in accordance with the invention comprises a plurality of heat exchange elements 31, an inlet member 34, an outlet member 35, two end tube plates 36, 37, a tube bundle 38 passing from one tube plate 36 to the other 37, the ends of the tubes being secured in apertures in the tube plates 36, 37 and two end closure domes 39, 40. Each heat exchange element 32, shown in more detail in FIGS. 8 and 9, comprises an outer cylindrical ring 41, a spiral baffle plate 43 and a central tube 44, all formed as an integral unit, e.g. by moulding or casting. As can be seen the spiral baffle plate 43 comprises a single curved sheet making one complete turn around the central tube 44 of the element 31 and each end 45, 46 lies in a plane containing a radius and the axis of the element. One end 45 protrudes beyond one extremity 47 (the upper extremity in FIGS. 8 and 9) of the ring 41 so that when assembled with other elements in the heat exchanger one end of the baffle plate 43 will directly abut the other end of the next baffle plate in the next element to form a smooth-surfaced spiral baffle 32 extending from the inlet member 34 of the exchanger 30 to the outlet member 35. Alternatively, the ends of each baffle plate can each be formed so as to lie in a plane containing the radius and the circumference of the extremities of the ring and the central tube, so again the end of one baffle plate will directly abut the other end of the next baffle plate to form a smooth-surfaced spiral baffle. The baffle plate in each element is formed with a plurality of apertures (not shown) through which the tube bundle passes. Some of the tubes 38 are shown in FIG. 7, the remainder being omitted for clarity.

Figure 8:
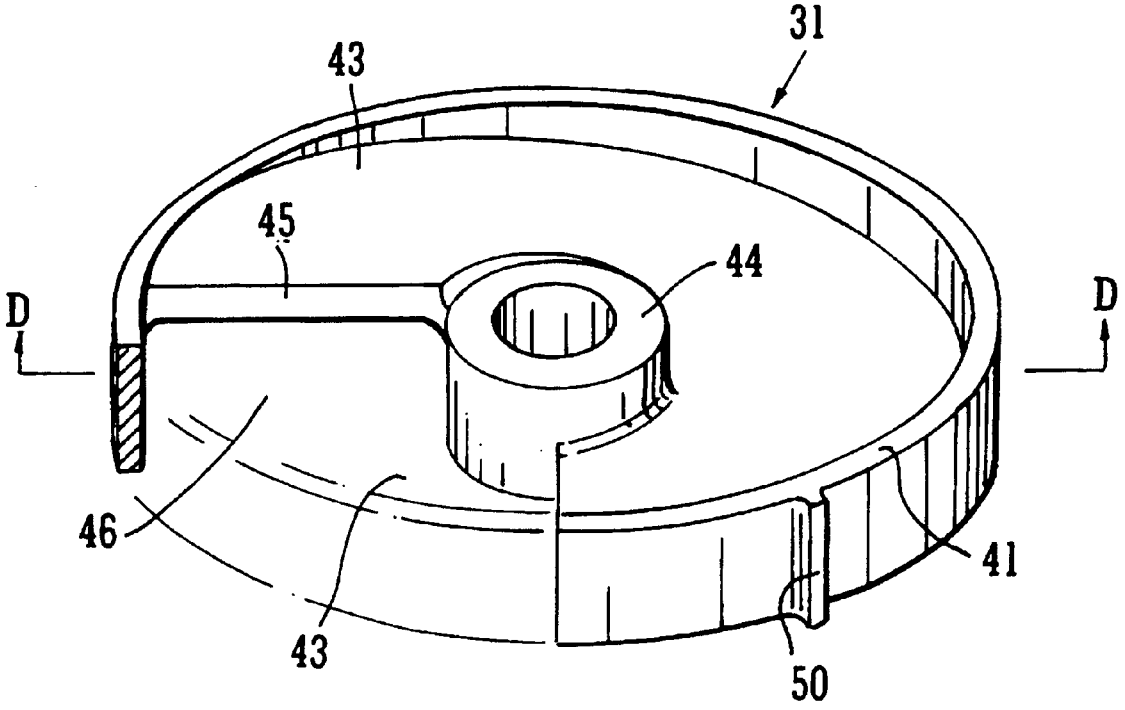
FIG. 8 is a perspective view of a heat exchange element.
Figure 9:
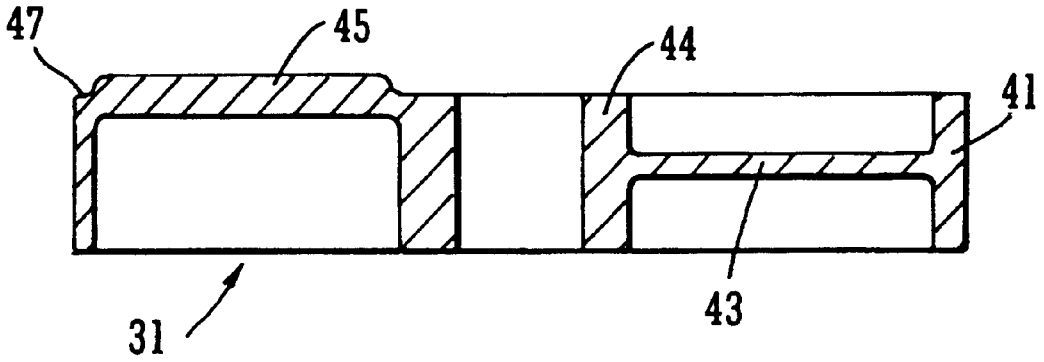
FIG. 9 is a cross-section on line D—D of FIG. 8.

As can be seen in FIG. 8 a rib 50 is formed on the outer surface of the ring 41. When assembling the elements this is aligned with similar ribs on other rings so as to ensure that the ends of the baffle plates are in correct abutting arrangement and the apertures in the baffle plates aligned so that the tubes may be positioned without difficulty.

The inlet and outlet members 34 and 35 respectively each have a generally cylindrical wall, having the same diameter and thickness as a ring 41 of an element 31. The inlet and outlet members are provided with respective connectors 52 and 53 for connection to pipework, fluid passing into the inlet member, around the tubes, guided by the spiral baffle and out through the outlet member. The circumferential region of the wall of one of the inlet and outlet members, in this embodiment the outlet member, is deformed outwardly to form a rib 60 which provides a means to compensate for any differential expansion between the tube bundle and the shell. The region may alternatively be deformed inwardly.

The end closure domes 39, 40 are provided with respective connectors 55 and 56 for connecting to pipework, fluid passing in through one connector and dome, through the tubes in the tube bundle and out through the other connector and dome.

The central tubes 44 of the elements 31 are joined together to form a long central tube lying on the axis of the shell and parallel to the tubes of the tube bundle. A pressure release valve (not shown) may be located in this central tube.

The heat exchanger is formed by joining together, end to end, the required number of modular elements by bonding with adhesive or welding, depending on the material of each element, securing the inlet and outlet members, again by adhesive bonding or welding and then affixing the end tube plates. The tubes of the tube bundle are then inserted into apertures in the one end tube plate, through the apertures on the spiral baffle to end in apertures in the other end tube plate. The tubes may be secured in the tube plate by any known means. The end closure domes are then secured by adhesive bonding.

In use one fluid such as oil passes into the inlet member 34 and is guided by the baffle around the outsides of the tubes 38 in the tube bundle in a helical path to the outlet member 35 where it leaves the exchanger. Some of this fluid may pass through the central tube is the pressure difference uses above a value determined by the pressure release valve. The one fluid exchanges heat energy with another fluid such as fuel passing through the tubes 38.

The flow of the one fluid is generally smoother than that through the shell and tube heat exchanger shown in FIGS. 1 to 6, not having to change direction so suddenly and so often. The heat exchange performance is therefore enhanced. The construction of the heat exchanger is such that as compared with known heat exchangers, there is an enhanced resistance to collapse when high pressures are present at each end tube plate.

What is claimed is:

1. A shell and tube type heat exchanger comprising a single outer tubular shell containing a spiral baffle path defied by a spiral baffle through which a tube bundle extends in a direction generally parallel with the longitudinal direction of the tubular shell, the heat exchanger comprising an assembly of a plurality of heat exchange elements each of which comprises a shell section which forms part of an axial length of the shell and a spiral section which forms part of a length of the spiral baffle path.

2. A shell and tube heat exchanger according to claim 1, wherein the shell and spiral sections are integrally formed by casting or moulding.

3. A shell and tube heat exchanger according to claim 1, wherein the spiral section is secured to a central member.

4. A shell and tube heat exchanger according to claim 3, wherein the spiral section is integrally formed with the central member by casting or moulding.

5. A shell and tube heat exchanger according to claim 3, wherein the central member is in the form of a rod or tube.

6. A shell and tube heat exchanger according to claim 1, wherein the spiral section is a spiral baffle plate in the form of a single curved sheet which executes at least one complete turn.

7. A shell and tube type heat exchanger according to claim 1, wherein a region of the shell extends around the whole periphery thereof, and is inwardly or outwardly deformed to allow differential expansion between the shell and tube bundle.

8. A shell and tube heat exchanger comprising:

a single elongate tubular shell having a tubular elongate shell intermediate portion made up only of a plurality of shell sections, each section comprising a tubular wall portion and a spiral portion within the tubular wall portion, the shell sections being assembled side-by-side along an axis of the tubular shell and connected one to another for said tubular wall portions to define the outer wall of said shell intermediate portion and for said spiral portions to define a spiral path extending around and along the axis of said shell intermediate portion;

two shell end portions connected to respective ones of the ends of said shell intermediate portion; and a plurality of tubes extending between said shell end portions and through respective apertures in said spiral portions.

9. The shell and tube heat exchanger according to claim 8, wherein each spiral portion defines a single complete turn.

10. The shell and tube heat exchanger according to claim 8, wherein the spiral portion of each shell section defines the same number of turns.

* * * * *